US005095666A

United States Patent [19]

Williams, Jr.

[11] Patent Number: 5,095,666

[45] Date of Patent: Mar. 17, 1992

[54] DEVICE FOR PROTECTING ROOF GUTTERS

[76] Inventor: Marvin G. Williams, Jr., 915 Windamere Ter., Hot Springs, Ark. 71913

[21] Appl. No.: 33,219

[22] Filed: Apr. 2, 1987

[51] Int. Cl.[5] ..... F04D 13/06

[52] U.S. Cl. ..... 52/11; 52/12; 52/24; 210/474

[58] Field of Search ..... 52/24, 11-16; 210/474

[56] References Cited

U.S. PATENT DOCUMENTS

| | | | |
|---|---|---|---|
| 2,209,741 | 7/1940 | Sullivan et al. | 52/11 |
| 2,219,953 | 10/1940 | Fry | 52/12 |
| 2,317,272 | 4/1943 | Hughes | 52/12 |
| 2,734,467 | 2/1956 | Steele | 52/12 |
| 2,841,100 | 7/1958 | Moller | 52/12 |
| 2,988,226 | 6/1961 | Campbell | 52/12 |
| 3,388,555 | 6/1968 | Foster | 52/12 |
| 3,507,396 | 4/1970 | Homa | 52/12 |
| 4,592,174 | 6/1986 | Hileman | 52/12 |
| 4,607,465 | 8/1986 | Hopkins | 52/12 |
| 4,644,704 | 2/1987 | Pedgonay | 52/12 |

FOREIGN PATENT DOCUMENTS

| | | | |
|---|---|---|---|
| 23080 | of 1892 | United Kingdom | 52/13 |
| 2138046 | 10/1984 | United Kingdom | 52/12 |

*Primary Examiner*—Richard E. Chilcot, Jr.
*Assistant Examiner*—Joanne C. Downs
*Attorney, Agent, or Firm*—George F. Helfrich

[57] ABSTRACT

Disclosed is a device for protecting a roof gutter so that the gutter will remain clean for the free flow of rain water therethrough. The device is a lid in the form of a curb overlying the rim of the gutter along the length thereof. The curb has a raised, porous edge rising above the rim of the gutter and forming a wall for catching and holding debris, while allowing rain water to pass therethrough. Special advantages are obtained when the device additionally includes a strip or toe section which is contiguous with the curb section and overlies that portion of the roof which is adjacent to the gutter. Both the curb section and the toe section of the device are advantageously porous throughout, being made from a meshed fabric.

7 Claims, 1 Drawing Sheet

DEVICE FOR PROTECTING ROOF GUTTERS

BACKGROUND OF THE INVENTION

1. Field of the Invention

This invention relates generally to roof gutters. It relates particularly to a device for protecting a roof gutter so that the gutter will remain clean for the free flow of rain water therethrough.

2. Prior Art

A well-known problem familiar to most of us is that roof gutters fill with debris—such as leaves, twigs, acorns, seed cases, and the like—especially in the spring and in the fall. Over the years a number of attempts have been made to solve this problem, and numerous expedients have been proposed. Worthy of note are those disclosed in the following U.S. patents, which constitute the closest art known to applicant: U.S. Pat. Nos. 3,977,135; 3,834,091; 2,841,100; 2,734,467; and 3,420,378. Notwithstanding the limited efficacy of these and similar expedients, they are all found wanting in one major aspect: since they are all flat screens which cover the roof gutter to which they are attached for protection, they are all easily covered and clogged with debris, often during a single rainfall. This accumulation of debris directly over the roof gutter effectively closes the gutter and allows rain water to flow thereover, instead of therein and therethrough.

SUMMARY OF THE INVENTION

It is accordingly the primary object of the present invention to provide what the prior art has been unable to provide, viz., a device for protecting a roof gutter so that the gutter will remain open, i.e., clean for the free flow of rain water therein and therethrough.

This object and other objects and benefits are achieved by the provision of a device including a lid in the form of a curb overlying the rim of the gutter along the length thereof, the curb having a raised, porous edge rising above the rim of the gutter and forming a wall for catching and holding debris while allowing rain water to pass therethrough.

Special advantages are achieved when the lid is porous throughout, as for example when the lid is constructed from a meshed fabric such as a metallic screen, a fiberglass screen, or a polymeric screen.

Very beneficial results are obtained when the transverse cross-sectional configuration of the curb is arcuate, or triangular, or quadrangular.

Moreover, the device of the present invention may additionally and advantageously include a strip which is contiguous with the lid and overlying that portion of the roof which is adjacent to the gutter. Special advantages are achieved when the strip is porous throughout, as for example when the strip is constructed from a meshed fabric such as a metallic screen, a fiberglass screen, or a polymeric screen.

BRIEF DESCRIPTION OF THE DRAWINGS

For a more complete understanding of the present invention, including its primary object and benefits, reference should be made to the Detailed Description of the Preferred Embodiments, which is set forth below. This Detailed Description should be read together with the accompanying drawings, wherein.

DETAILED DESCRIPTION OF THE PREFERRED EMBODIMENTS

The device of the present invention is simple and unique in design and construction, and it can be easily attached to a variety of roof gutters or roofs of any pitch. Moreover, it can be easily mitered for making corners.

In a preferred embodiment, the present invention includes an elongated power strip, for example of mesh, or mesh in combination with solid material, which can be made of metal, polymeric material, fiberglass or the like. A preferred configuration is such that a flat section or toe rests on the roof for collection of trash, and a raised or lid overlies the roof gutter. The lid or raised section acts as a curb or wall to retain trash on the roof, while still allowing runoff to flow over the trash and into the roof gutter. The toe portion is continuous with the lid portion, or it can be contiguously attached with a limiting hinge that will fold to match the pitch of the roof (but will fold out to a 90 degrees maximum opening).

In its broadest aspect, the present invention comprehends a curb overlying the rim of a gutter along the length thereof, to which curb a flat strip or toe is advantageously attached. The edge of the curb which forms the wall for catching and holding debris is necessarily porous, and it is advantageous, though not essential, that the entire lid be porous throughout, as when constructed from a meshed fabric such as a metallic screen, a polymeric screen, or a fiberglass screen.

The lid or curb section is attached to the outer edge of a roof gutter with a variety of clip on, insertion or, screw-fastened type hinges. The hinge pin can be an integral part of the curb or raised section, or it can be a separate wire-type pin that is installed through an eye in the curb section. The entire assembly can be pivoted outwardly and downwardly by the use of a hooked rod which is operated from ground level, by hooking an eye attached to the curb section, or which is attached to the hinge pin wire, or which is an integral part of the curb section.

Figure 1:
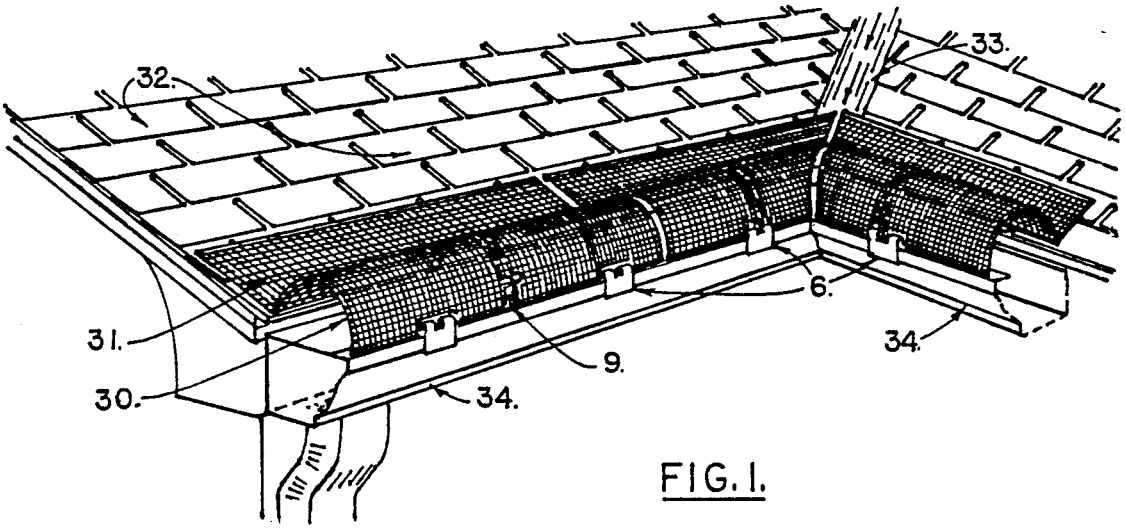
FIG. 1 is a perspective view illustrating a preferred embodiment of the present invention mounted in an operational position upon a standard roof gutter, showing the use of molded vinyl polymer hinges designed specifically for this invention.

Referring now to the drawings, FIG. 1 shows the curb 30 according to the present invention, which prevents trash from clogging the roof gutter and leaders while containing the roof trash for proper disposal under favorable conditions. The material of construction may be any rigid or semi-rigid welded or woven wire fabric, fiberglass mesh, vinyl polymer mesh and/or other non-corrosive material which lends itself to being shaped, and once shaped to retain the proper shape for extended time periods of ten (10) or more years. Toe section 31 attaches to the curb section and is a part of a preferred embodiment of the instant invention. Its purpose is to separate trash from trees (or other items falling upon roofs) from rain water, permitting the water flow with minimum resistance into the roof gutter, while also serving as a trash collector until said trash can be removed under favorable conditions. This trash containment feature of the instant invention makes it unique, when compared with other gutter screening devices. Roof shingles 32 as shown are commonly called strip shingles. However, the instant invention lends itself favorably to use with any configuration of roof shingle or roofing material. Roof valleys 33 are difficult to screen with currently available rigid metal screens. However, the instant invention is easily fitted to achieve maximum racking of litter and organic trash. Roof drain gutters or eave troughs 34 are commonly used today. However, the instant invention can be easily installed on any roof drain gutter and/or eave trough, whether or not the guttering is attached to the eave or constructed in the roof itself. Wire support 9 helps maintain the shape of curb 30 and assists in maintaining its integrity during installation. It is shown in more detail in FIG. 9. Molded vinyl polymer hinge 6 may be snapped onto the lips of most metal or vinyl polymer rain gutters. Hinge 6 is shown in more detail in FIG. 6.

Figure 2:
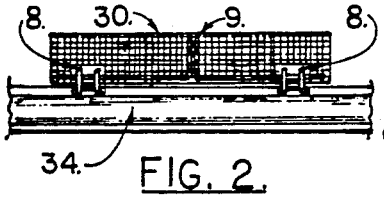
FIG. 2 is a side elevation of a long section of the embodiment of FIG. 1, showing the use of rigid wire hinges designed specifically for this invention.
Figure 8:
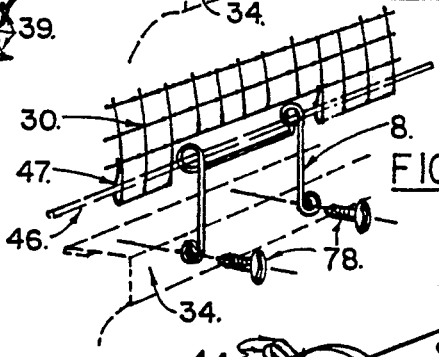
FIG. 8 is an exploded perspective depicting the rigid wire hinge, the use of which is shown in FIGS. 2, and 5.

Referring now to FIG. 2, there is shown a long section of a device according to the present invention, which is outfitted with wire support frame 9, and rigid wire hinges 8, which are designed specifically for this invention and are shown in more detail in FIG. 8. It is especially advantageous if the fabric which constitutes curb 30 has openings of not less than ⅛ inch nor more than ¼ inch. Rabbit wire, hardware fabric, and wire mesh are common terms for such fabric, which may be constructed from aluminum, galvanized metal, fiberglass, or polymeric material.

Figure 3:
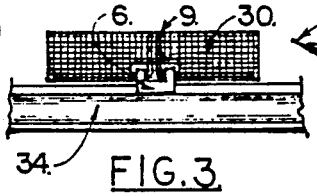
FIG. 3 is a side elevation of a short section of the embodiment of FIG. 1, showing the use of a molded vinyl polymer hinged designed specifically for this invention.
Figure 4:
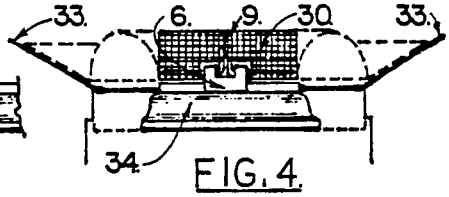
FIG. 4 is a side elevation of a short end section of the embodiment of FIG. 1, at its terminus with a roof valley.

Referring now to FIG. 3, there is shown a short section of a device according to the present invention, which is outfitted with wire support frame 9 and a single molded vinyl polymer hinge 6. FIG. 4 depicts a short end section of a device according to the present invention at its terminus with roof valley 33, illustrating the ability to custom fit the device of the present invention to any valley condition without any impairment of the function of the present invention.

Figure 5:
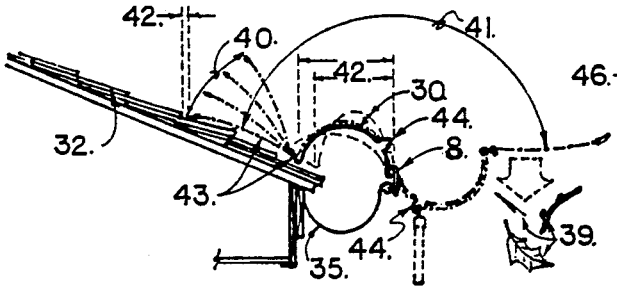
FIG. 5 is cross-section of the embodiment of FIG. 1, illustrating the operation thereof.

FIG. 5 shows the instant invention in cross-section and illustrates the ability of the strip or toe section as at 43 to match any reasonable roof slope or pitch 40. This Figure also illustrates the ability of curb 30 to be molded at each installation so that the upper edge of the gutter will fall within ½ inch of the shingles tab 42, as is preferred. Also shown in this Figure is the rotation 41 of the instant device about hinge 8 for the purpose of discharging accumulated debris 39. Further illustrated is the ability of the device of the present invention to be mounted on older types of rain gutters 35.

Figure 6:
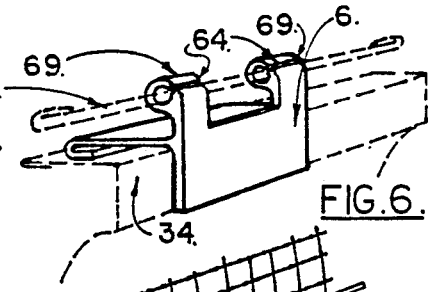
FIG. 6 is a perspective view illustrating the molded vinyl polymer hinge, the use of which is shown in FIGS. 1, 3 and 4.

In FIG. 6 there is depicted a molded vinyl polymer hinge 6, which is designed especially for the present invention. This hinge can be snapped onto the lips of most metal or vinyl polymer rain gutters 34. Hinge 6 advantageously includes pop-in hinge pin jaws 69 and slot 64 which facilitate a popping attachment to curb section 30 by means of support wire clasp 46 which is attached to the welded or woven mesh fabric.

Figure 7A:
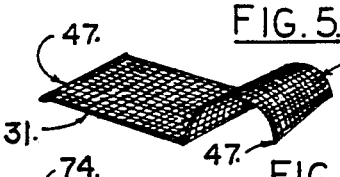
FIGS. 7A, 7B, and 7C are perspective views illustrating the present invention in preferred embodiments wherein the curb section thereof is arcuate, quadrangular, and triangular, respectively.
Figure 7B:
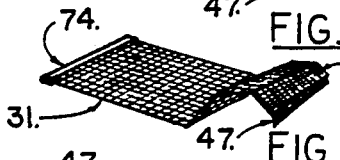
Figure 7C:
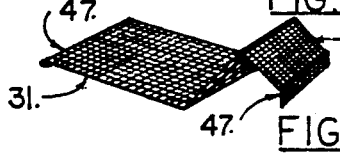

Pictured in FIGS. 7A, 7B, and 7C are three preferred embodiments of the curb section 30 of the present invention in contiguous relationship with the strip 31 or toe section thereof. Shown are arcuate (7A), quadrangular (7B), and triangular (7C) configurations, which are chosen to enhance the architectural features of the building or roof line to which the device of the present invention is applied. The welded or woven fabric should be folded over or lapped by about ½ inch as at 47, in order to provide greater stability to the fabric. This fold or lap also provides the conduit for the support frame wire. Metal edging trim 74 is an optional feature for the upper edge of strip 31 which constitutes the toe section of the device of the present invention.

Figure 9:
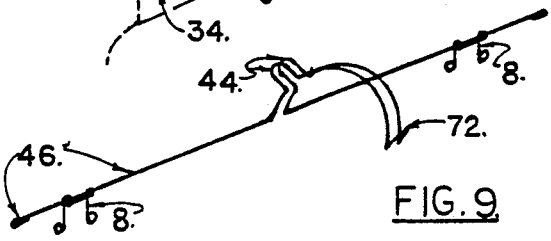
FIG. 9 is a perspective view illustrating a rigid wire support frame which is advantageously employed with long sections of the present invention, as depicted in FIG. 2.

In FIG. 8 there is shown a rigid wire hinge which is specifically designed for the light load requirements of the instant invention. This hinge can be used advantageously with a long hinge rod as seen in FIG. 9. It is attached to gutter 34 by means of screws 78 and to curb section 30 by means of support wire clasp 46 which is contained in lap 47.

FIG. 9 schematically depicts a rigid wire support frame which is advantageously employed with longer sections of the device according to the present invention, assisting in the maintenance of the shape of the curb section and the integrity thereof throughout the installation. This frame also minimizes warping of the mesh on roofs which collect large amounts of debris. Flipping loop 44 and lifting tongue 72 are formed on the wire frame itself to facilitate pulling up of the curb section during the discharging of accumulated debris and forcing the device back to its original position.

The present invention has been described in detail with respect to certain preferred embodiments thereof. However, as is understood by those of skill in the art, variations and modifications in this detail may be made without any departure from the spirit and scope of the present invention, as defined in the hereto-appended claims.

What is claimed is:

1. A device for protecting a roof gutter having a rim so that the gutter will remain clean for the free flow of rain water therethrough, which device comprises a lid in the form of a curb overlying the rim of the gutter along the length thereof, the curb having a raised, porous edge rising above the rim of the gutter and forming a wall for catching the holding debris while allowing rain water to pass therethrough, the device additionally comprising a strip which is contiguous with the lid and overlying that portion of the roof which is adjacent to the gutter.

2. A device according to claim 1, wherein the transverse cross-sectional configuration of the curb is arcuate.

3. A device according to claim 1, wherein the transverse cross-sectional configuration of the curb is triangular.

4. A device according to claim 1, wherein the transverse cross-sectional configuration of the curb is quadrangular.

5. A device according to claim 1, wherein the strip is porous throughout.

6. A device according to claim 5, wherein the strip is constructed from a meshed fabric.

7. A device according to claim 6, wherein the meshed fabric is selected from the group consisting of a metallic screen, a fiberglass screen, and a polymeric screen.

* * * * *